US005398706A

United States Patent [19]

Epstein

[11] Patent Number: 5,398,706

[45] Date of Patent: Mar. 21, 1995

[54] COSMETIC CASE

[75] Inventor: Bernie Epstein, Sherman Oaks, Calif.

[73] Assignee: Funrise Toys Ltd., Kowloon, Hong Kong

[21] Appl. No.: 137,892

[22] Filed: Oct. 15, 1993

Related U.S. Application Data

[63] Continuation of Ser. No. 939,992, Sep. 3, 1992, abandoned.

[51] Int. Cl.[6] ..... A45D 33/24; A45D 33/26

[52] U.S. Cl. ..... 132/294; 132/314; 446/76; 446/472

[58] Field of Search ..... 132/287, 294, 295, 297, 132/314; 206/581, 823; 446/76, 472

[56] References Cited

U.S. PATENT DOCUMENTS

| | | | |
|---|---|---|---|
| 2,035,356 | 3/1936 | White et al. | 132/294 |
| 2,233,366 | 2/1941 | MacGregor | 132/314 |
| 2,851,041 | 9/1958 | Grosso | 132/294 |
| 3,132,652 | 5/1964 | Gazdik | 132/297 |
| 3,482,728 | 12/1969 | Flax | 132/314 |
| 3,851,655 | 12/1974 | Tarro | 132/294 |
| 5,025,817 | 6/1991 | Wen | 132/294 |

*Primary Examiner*—John G. Weiss
*Attorney, Agent, or Firm*—Lewis Anten

[57] ABSTRACT

A compact case has a circular bottom cosmetic holding compartment consisting of a tray having a series of pre-shaped depressed segments, and an upper cover that has an opening corresponding to the pre-shape of the depressed segments. The upper cover is rotatable in relationship to the bottom cosmetic holding compartment so that it may be rotated to permit access to individual cosmetics held in the depressed segments as desired. A pull out tray is included in the bottom compartment for holding cosmetic components.

1 Claim, 2 Drawing Sheets

COSMETIC CASE

This application is a continuation of application Ser. No. 07/939,992, now abandoned filed on Sep. 3, 1992.

BACKGROUND

There have been a number of cosmetic compacts that hold different colors of cosmetics. In a typical cosmetic holder, the cosmetic material is solid and can be applied to a brush which is then applied to the face or other body part of the user. The cosmetics are typically contained in a flat square or rectangular tray having different segments separated by a raised ridge. A cover, pivotable along one side, permits access to all of the different segments of cosmetics at the same time.

Having access to all of the different cosmetic compartment at the same time permits them all to spill if the item is dropped, as is often the case with children using cosmetics, or to have the cosmetic of one compartment or segment contaminate the next or adjacent compartments.

SUMMARY OF INVENTION

A compact case has a circular bottom cosmetic holding compartment consisting of a tray having a series of pre-shaped depressed segments, and an upper cover that has an opening corresponding to the pre-shape of the depressed segments. The upper cover is rotatable in relationship to the bottom cosmetic holding compartment so that it may be rotated to permit access to individual cosmetics held in the depressed segments as desired. A pull out tray is included in the bottom compartment for holding cosmetic components.

OBJECTS OF THE INVENTION

It is an object of the present invention to provide an improved cosmetic compact that is easy to use;

It is another object of the present invention to provide a cosmetic compact that prevents contamination of adjacent cosmetics;

It is yet another object of the present invention to provide a compact that is less likely to be damaged if it is dropped.

These and other objects of the present invention will be apparent from a review of the accompanying drawings and specifications.

DETAILED DESCRIPTION OF DRAWINGS

Figure 1:
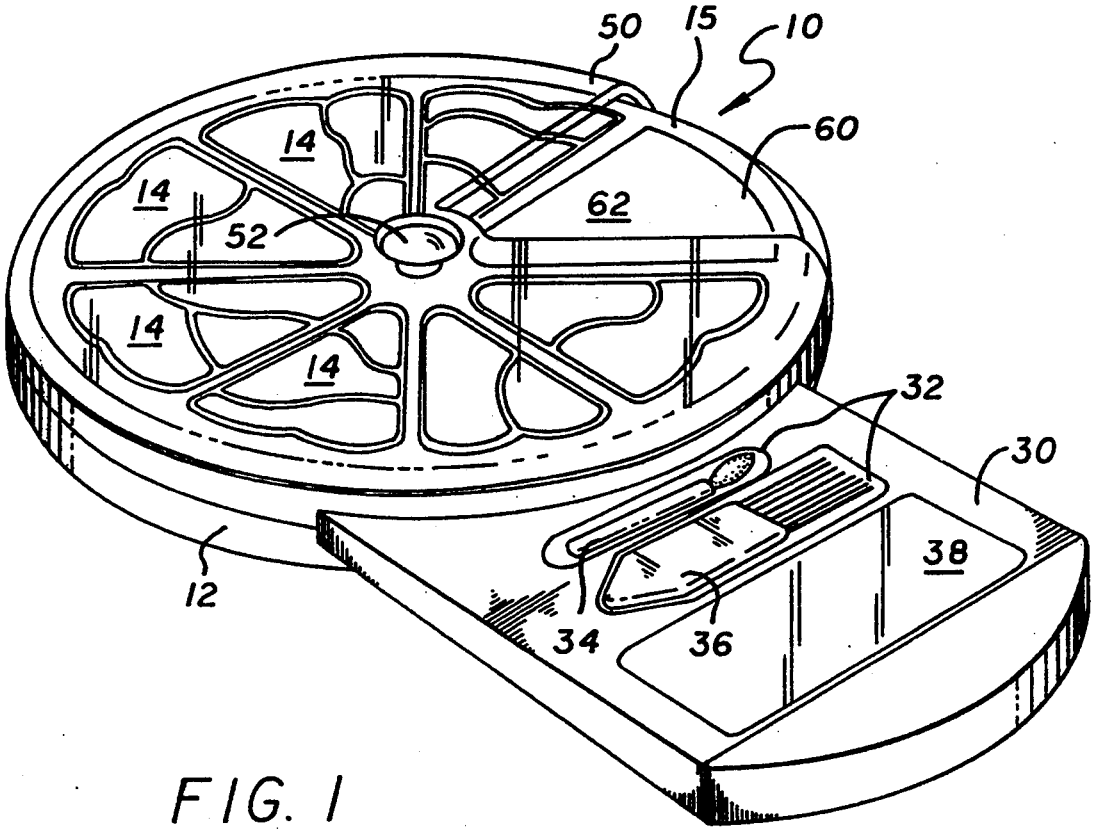
FIG. 1 is a perspective view of the compact, showing the draw in its open position.
Figure 4:
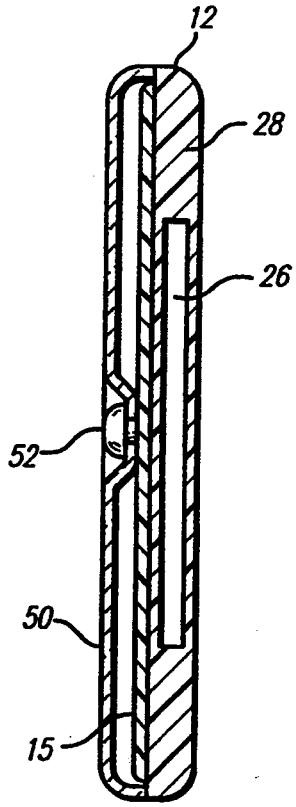
FIG. 4 is a side sectional view take along lines 4—4 of FIG. 2.
Figure 2:
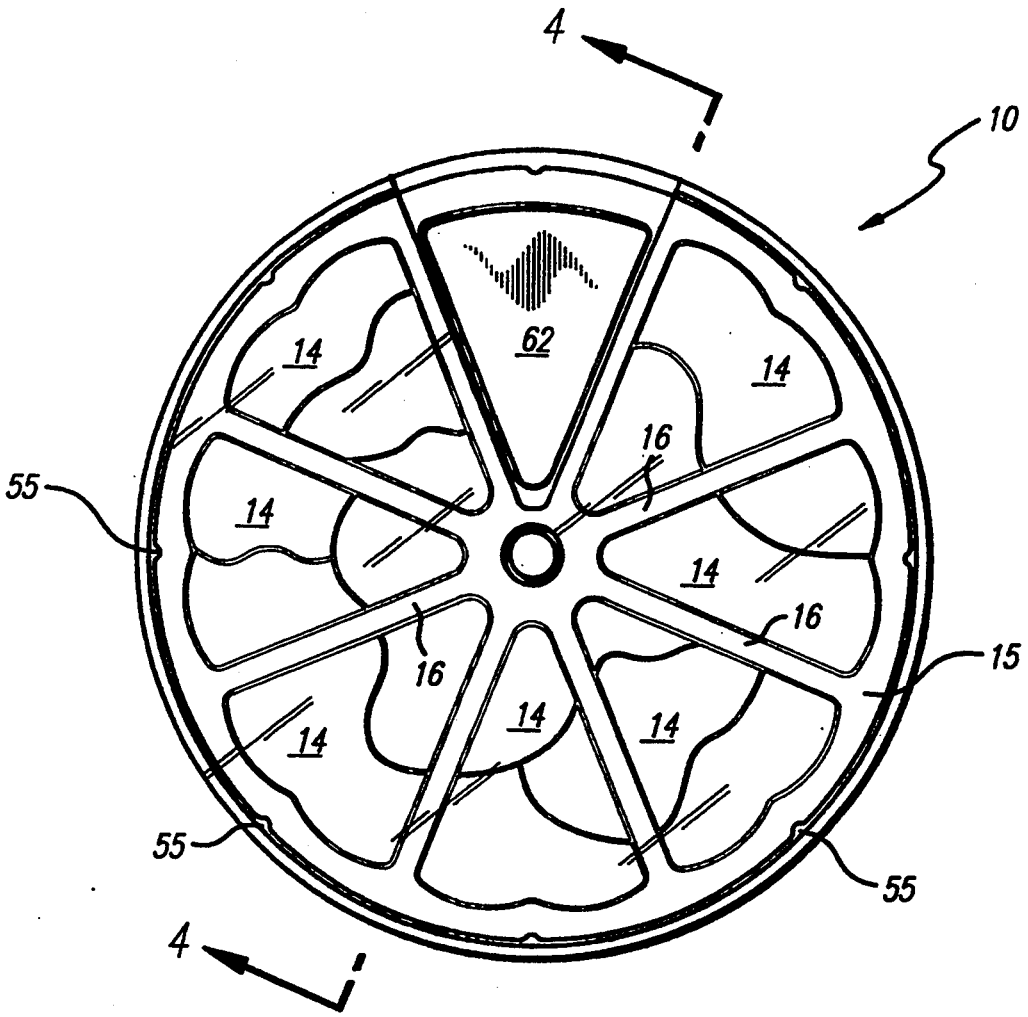
FIG. 2 is a top view of the present invention.
Figure 3:
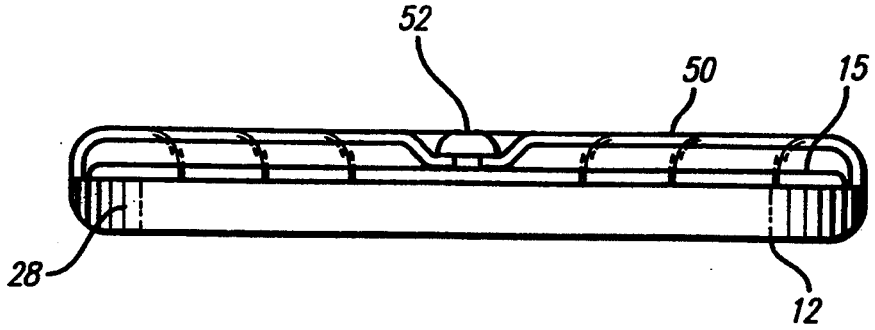
FIG. 3 is a side view of the compact of the present invention.

Referring to the drawings the compact is referred to generally as 10. The compact 10 has a circular bottom portion member compartment 12 containing a cosmetic holding tray 15 having a series of pre-shaped cosmetic holding compartments 14. Each of the compartments is separated from the next compartment by a raised ridge 16. The depth of the compartments 14 is less than half the thickness of the circular bottom member 12, permitting the formation of a opening 26 in the side wall 28 of the bottom member 12. A drawer 30 having the height and width of the opening 26 is slidably fitted within said opening 26. The depth of the drawer 30 is less than one half the diameter of the circular bottom member 12, so that it may be fully inserted into the bottom member. The drawer 30 has a series of depressions 32 for holding various components, such as brushes 34 and 36, as well as a mirror 38.

A circular upper cover 50, having a diameter corresponding to the diameter of the bottom member 12, fits over the bottom member 12. The center of the upper cover 50 has a pin 52 that projects into a corresponding opening in the center of the bottom member 12, so that the circular upper cover 50 can be rotated in relationship to the bottom member 12. Detents 55 percent of the free rotation of the upper cover 50 and the bottom member 12.

The upper cover 50 has an opening 60 corresponding to the shape of the pre-shaped cosmetic holding compartment 14 in the bottom compartment 12, whereby the various compartments 14 in the cosmetic holding tray 15 may be accessed from the outside of the compact without the remaining segments or depressions 14 being accessible. One of the compartments 62 in the tray 15 has no cosmetics, so that when stored, the opening is fitted over this compartment 62.

In the preferred embodiment of the present invention, the various components of the compartment would be molded from various plastic materials. The upper cover 50 would be at least partially transparent so that the cosmetics in the different compartments 14 could be observed and the desired cosmetic obtained by rotation of the cover 50 until the desired cosmetic was beneath the opening 60 in the upper cover 50. The drawer 30 would be opened and the user would take the appropriate implement, such as the brush 32, and apply the cosmetic to the brush 32. The user would then use the mirror 38 to apply the cosmetics to the face.

In the preferred embodiment the compact 10 would have an outside diameter of about $4\frac{1}{2}$ inches and a height of about 9/32 inch. The bottom member would have a height of 5/32 inch and the upper cover 50 would have a depth of $\frac{1}{4}$ inch. The drawer 30 would have a height of 3/32 inches, about $2\frac{1}{2}$ inches wide and about 2 inches deep.

While the present invention has been described with reference to the preferred embodiment, it is understood that other variations of the present invention may be made without departing from the inventive concept.

What I claim is:

1. A compact for holding cosmetics comprising a cylindrical bottom member, a cylindrical upper cover, the upper cover being rotatable relative to said bottom member, the cylindrical bottom member including a cosmetic holding tray having a plurality of depressions forming cosmetic holding segments in said tray and said cover including an opening for access to at least one of said cosmetic holding segments, said cosmetic holding tray having a flat segment at least as large as said opening in said cover, said flat segment closing said compact when said opening is aligned with said flat segment, a detent means for holding said cover relatively fixed to said cylindrical bottom member and preventing full rotation of said cover, said cylindrical bottom compartment member includes a pull out drawer, said drawer having a width and length greater than the radius of said upper cover and includes compartments for holding objects, said drawer positioned between said bottom member and said cosmetic holding tray.

* * * * *